US008048266B2

(12) United States Patent
Katajamäki et al.

(10) Patent No.: US 8,048,266 B2
(45) Date of Patent: Nov. 1, 2011

(54) METHOD OF MANUFACTURING A MULTILAYER FIBROUS PRODUCT

(75) Inventors: Seppo Katajamäki, Tampere (FI); Esa Hassinen, Lappeenranta (FI); Tom Nickull, Palokka (FI)

(73) Assignee: M-real Oyj, Espoo (FI)

( * ) Notice: Subject to any disclaimer, the term of this patent is extended or adjusted under 35 U.S.C. 154(b) by 0 days.

(21) Appl. No.: 12/310,884

(22) PCT Filed: Sep. 11, 2007

(86) PCT No.: PCT/FI2007/050479

§ 371 (c)(1), (2), (4) Date: Nov. 18, 2009

(87) PCT Pub. No.: WO2008/031921

PCT Pub. Date: Mar. 20, 2008

(65) Prior Publication Data

US 2010/0059190 A1 Mar. 11, 2010

(30) Foreign Application Priority Data

Sep. 11, 2006 (FI) ..... 20060809

(51) Int. Cl.
*D21H 27/38* (2006.01)

(52) U.S. Cl. ..... 162/130; 162/125; 162/129; 162/149; 162/189; 162/191

(58) Field of Classification Search ..... 162/125, 162/129, 130, 132, 133, 149, 189, 190, 191
See application file for complete search history.

(56) References Cited

U.S. PATENT DOCUMENTS 4,781,793 A * 11/1988 Halme ..... 162/55
4,888,092 A * 12/1989 Prusas et al. ..... 162/130
6,391,154 B1 * 5/2002 Nygard et al. ..... 162/135

* cited by examiner

*Primary Examiner* — Eric Hug
*Assistant Examiner* — Peter Chin
(74) *Attorney, Agent, or Firm* — Kubovcik & Kubovcik

(57) ABSTRACT

A method of manufacturing a multilayer fibrous product. The product comprises at least two overlapping layers, each of which has a different fiber composition, and in the production of the product, chemical short stock is used at least partly. In the method, short stock is brought to a screening stage where fines, which pass a screen having an average hole size of 0.2-1.5 mm, are separated from it, in order to prepare at least two fiber fractions having different fiber compositions, and the fractions generated are recovered and included in different layers of the same fibrous product. With the invention, it is possible to screen an initial material and form a product which has better properties than a corresponding product, the initial material pulp of which has only been refined.

22 Claims, 5 Drawing Sheets

METHOD OF MANUFACTURING A MULTILAYER FIBROUS PRODUCT

This application is a 371 of international application PCT/FI2007/050479, filed Sep. 11, 2007, which claims priority based on Finnish patent application No. 20060809 filed Sep. 11, 2006, which is incorporated herein by reference.

The present invention relates to a method of manufacturing a multilayer fibrous product.

A product such as this generally comprises at least two overlapping layers, which have different fibre compositions. In the production of the product, chemical short stock is used at least partly.

Fractionation of the fibrous pulp used for producing paper or cardboard and the using of the fractions in different layers have for many years been applied especially to cardboards and tissues which are prepared of recycled fibre. Fractionation of long stock, too, is common. Nowadays, fractionation and using the fractions in different layers can also be applied to manufacturing printing papers, when the printing papers are manufactured by using a multilayer web technique.

Fractionation has been used for a long time but it has been mainly limited to treatment of mechanical pulp and recycled fibre. The fractionation of chemical pulp has been applied much less than fractionation of recycled fibre or mechanical pulp, and even then, it has been applied mainly to softwood pulp. The fractionation of pulp enables the production of optimal structures, especially in products which have been manufactured by using the multilayer technique. It is also possible to use fractionation to separate the fines from the pulp, in which case the remaining long stock fraction improves the tensile strength when compared at the same freeness level. Fractionation can be carried out either with centrifugal cleaners or with screens or a combination of these. Screens make it possible to grade the fibres mainly according to the length of the fibre, whereas the centrifugal cleaner grades the fibres according to their density and specific volume.

Fractionation of softwood pulp has been described for instance in the following publications: Sari Panula-Ontto, "Sellun fraktioinnilla räätälöityihin tuotteisiin", KCL Linkki 3/2003, p. 7, Sari Panula-Ontto, "Fractionation of unbleached softwood kraft pulp with wedge wire pressure screen and hydrocyclone", Licentiate thesis, 2003, Allison & J. Olson, "Optimization of multiple screening stages for fibre length fractionation: Two stage case", Journal of Pulp and Paper Science, no. 3, 2000, pp. 113-119.

The centrifugal cleaning technique described above cannot be used industrially because the consistency values are so small that the separate concentrating measures that are required are too expensive.

Kari Koskenhely et al., in their publication "Effect of refining intensity on pressure screen fractionated softwood kraft", Nordic Pulp & Paper Research Journal, no. 2, 2005, pp. 169-175, wrote that the principle behind the fractionation of softwood pulp is that the fractions can be refined separately in an optimal way, and then be used in suitable products, or, alternatively, in the different layers of multilayer cardboards. For instance, low intensity grinding improves the tensile strength/drainage resistance ratio of the long stock fraction.

In an invention described in U.S. Pat. No. 6,068,732, the stiffness of cardboard having at least three layers is increased by using fractionation in such a way that the softwood pulp is fractionated using a hole screen into short and long fibre fractions. The long fibre fraction is then used for the surface layers of the cardboard, whereas the short fibre fraction is used, mixed with hardwood pulp, for the middle layer. This fibre mixture can be used as part of the fibre mixture of the surface layers, too. Moreover, the middle layer may also contain mechanical pulp 20-50%. The pulp used is BCTMP.

FI Patent No. 75200 describes fractionation of basic pulp into long and short fibre fractions. The long fibre fraction is used in layers which are directly in contact with the wire and the short fibre fraction in the middle layer, or in the case of a Fourdrinier wire, on the top of the wire layer. In this way, especially the retention is improved. After the fractionation, the long fibre fraction is refined and then refractionated. The resulting short fibre fraction is then mixed with the short fibre fraction from the first fractionation. The basic pulp may be a mixture of chemical and mechanical pulp, but it may also comprise only chemical pulp having fibres of different lengths. The basic pulp comprises the broke, too.

According to T. Bliss in "Pulp fractionation can benefit multilayer paperboard operations", Pulp & Paper, no. 2, 1987, pp. 104-107, the general purpose of fractionation of recycled fibres is to improve the strength/freeness-ratio of the fraction, to save energy used for refining or to minimize the generation of fines in the refining. It is possible to adjust the properties of multilayer cardboard by choosing the right fractions for the right layer.

Risto Weckroth, in his Master's thesis, "Koivusulfaattimassan ominaisuudet ja laadun parantaminen kolmikerroskartongin valmistuksen kannalta", a Master's thesis, Helsinki University of Technology, 1991), writes that birch pulp—among other things—has been fractionated in order to remove the fines or fines together with short fibres. However, only the effect of the fractionation on the bulk of the birch pulp, with particular regard to its usage in the middle layer of the cardboard, has been studied.

Complete utilization of the fractions generated by the fractionation has been difficult. A fractionation is never complete because it is a statistical process. When using the centrifugal cleaning technique, it is possible to separate only approximately half of the long fibres into different fractions. As a result, a fraction is generated which as such is appropriate for the desired fibre layer. However, the question of how to use the remaining pulp remains unanswered, which presents both paper technology and economic problems.

The flexural strength of cardboard, especially folding boxboard, is one of its most important quality properties. It is possible to improve it, either by increasing the tensile stiffness, i.e. the modulus of elasticity, of the surface and backing layers (which typically comprise pulp), or by increasing the dimension of the structure, especially of the middle layer. It is possible to increase the tensile stiffness (modulus of elasticity) of the pulp by increasing the refining, but the refining process generates a more compact fibre network which, in turn, hinders considerably the dewatering of the middle layer, in which case it limits the capacity or causes blistering and delamination phenomena (=local swelling of the surface layer and detaching of the layers).

Among the short stocks, birch pulp is an interesting raw material in cardboard manufacturing, because it has a combination of a fairly good strength and significantly better optical properties than softwood pulp. When the refining of birch pulp is increased, the dewatering at the wire deteriorates, which, in turn, causes runability problems on the cardboard machine, and delamination starts to appear in the product as the porosity decreases.

It is an aim of the present invention to eliminate at least a part of the disadvantages associated with known technology and to provide a novel solution for the production of a multilayer fibrous product, especially from short stock. The present invention is based on the idea that the short fibre stock, i.e. in practice hardwood pulp, is subjected, before the webbing stage, to mechanical classification, where the fines are first separated from the pulp. Most suitably, fines that pass a screen having an average hole size of approximately 0.2-1.5 mm are separated. The classification is carried out using a screen. After that, the fines and the reject from the screening are separately recovered to provide two different fibre material fractions which can be incorporated into different layers of the multilayer product. In this case, it is more preferable to use the reject of the screening, i.e. the "long fibre fraction", in the layer which must have a good tensile strength. We have found that by removing the fines from a fraction like this, which generally forms the surface layer, it is possible to increase the degree to which the pulp is refined without any considerable deterioration in the dewatering or the porosity.

Considerable advantages are obtained by means of the present invention. The tensile strength and the tensile stiffness of the long fibre fraction, which is generated in the fractionation, i.e. the screening, are improved and they are significantly better than those of the feed pulp, at the corresponding level of drainage and porosity.

With a controlled removal of the fines (either before or after the refining) it is possible to improve, in the grinding process, the modulus of elasticity of the short stock, such as birch pulp, without losing much of the porosity. The fines which have been separated in the fractionation are utilized for instance in the middle layer of a three-layer cardboard, such as folding boxboard, in which case it is possible to increase the internal strength and the setting ability. At the same time, the stiffness and the porosity of the surface layer, which is free of fines, is improved. The internal bond strength of the middle layer is improved when the percentage of fines is increased, for instance when used to substitute part of the broke pulp which is generally used in the middle layer.

However, it is also possible to prepare for instance tissues or similar products in which the long fibre fraction is inside the multilayer product while the fines-rich fraction forms its surface layers.

We have discovered that the yellowing brightness reversion decreases when a fraction comprising extractives and small particles is inserted into the middle layer of a multilayer product. When the surface comprises fewer extractives, the product is cleaner, too.

Because a screen is used in the classification, the consistency of the fines fraction is so high that no separate dewatering stage is needed. Instead, the fines fraction obtained from the screen is recovered and used as such in the form of an aqueous suspension of fibrous material.

In the following, the present invention will be examined more closely with the help of a detailed explanation and with reference to the accompanying drawings.

FIG. 1*a* is a schematic description of the treatment of short stock, according to the present invention;

FIG. 1*b* shows the treatment of pulp in conditions where the fines fraction is recovered at a low consistency, and FIG. 1*c* shows the refining of pulp without fractionation;

In the present invention, fractionation (in particular fractionation using a hole screen) of birch is carried out in order to improve the quality of the birch pulp.

Figure 1A:
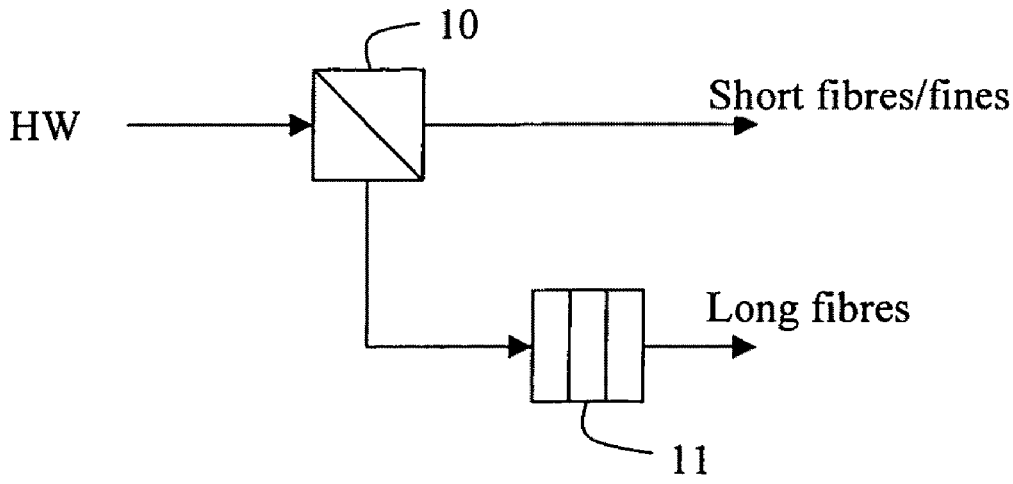

As will become apparent from FIG. 1*a*, birch pulp is fractionated with a screen 10 in order to remove fines. As a result, it is possible to increase the refining 11 of the remaining fibre pulp without either dewatering or a significant deterioration in the porosity of the pulp. Thus, the long stock fraction and the fines can be optimally used to improve the strength properties in the different layers of the folding boxboard. The generated fines fraction can be used in the middle layer as an "adhesive" to give the structure more strength, in which case there is no need to refine very much the fibres of that layer either. Instead, the fibre network remains more bulky and the flexural strength of the whole layer structure is improved as well.

According to the present invention it is thus possible to utilise the feed pulp as a whole in the preparation of the product by separating the long stock fraction and the short stock/fines fraction from each other, in which case, if needed, the fractions are further separately processed before they are fed into the different layers of the same multilayer product. If desired, part of one fraction or of both fractions can in principle be used in the production of another product, but naturally it is most rational to use the feed pulp as a whole in the preparation of one single product.

Preferably, the short stock used in the present invention is a chemical pulp which is prepared of hardwood by using an alkaline cooking process. It is prepared by using as raw material wood of the *Betula* genera, *Populus* genera, *Eucalyptus* genera or the *Akasia* genera, or a mixture of two or more of these.

It is possible to prepare the products entirely of hardwood, typically the percentage of the chemically prepared hardwood fibres is 50-100 weight-% of the surface layer pulps, but it is also possible to use mixtures of softwood pulp and hardwood pulp. Most suitably, the maximum percentage of softwood fibres prepared from chemical pulp is 50%. The length of the hardwood fibres is naturally approximately one third of the length of the softwood fibres. Thus, it is possible to generate fines from hardwood with less refining. Because for instance birch pulp has good strength properties compared with many other hardwood species, it is most suitable for that layer of a multilayer cardboard which gives the cardboard its flexural strength. In a three-layer cardboard, this layer is preferably the surface and/or the backing layer. When the flexural strength of the cardboard is improved, its grammage can be reduced, too.

In non-fractionated birch pulp, the percentage made up of fines is approximately 4-6.5%, as determined by the DDJ method, i.e. typically the fraction passes a 200 mesh screen. By refining the fibres, the quantity of fines is increased. According to the present invention, by using fractionation it is possible to increase the fines percentage of the fines fraction of birch pulp to as much as 8-9% in folding boxboard, with favourable fractionation parameters to as much as 11-12%. In other products, the percentages of the fractions vary depending on the product. It is possible to change the fractionation ratio by changing the fractionation and refining parameters.

According to the present invention, a portion of fibre material of at least approximately 5 weight-%, most suitably approximately 5-30 weight-%, especially approximately 7-25 weight-%, as calculated from the fibre material of the pulp, is separated from the pulp using a screen, and which portion comprises fines which pass a 0.2-1.5 mm screen. For folding boxboard applications, the average aperture size of the screen used is preferably approximately 1.0 mm or slightly less, such as approximately 0.8 mm. The free area of the screen (i.e. the area with no holes) is generally approximately 20-80%, especially approximately 25-75%, of its total area.

The fines fraction obtained from the screen is recovered in the form of an aqueous suspension of fibre material. In order to prepare a fibrous product, this suspension of fibre material and water can be mixed as such with the other pulp components of the middle layer without a separate dewatering. The consistency of this suspension of fibre material is approximately 0.5-2 weight-%, especially approximately 0.8-1.5 weight-%.

Figure 1B:
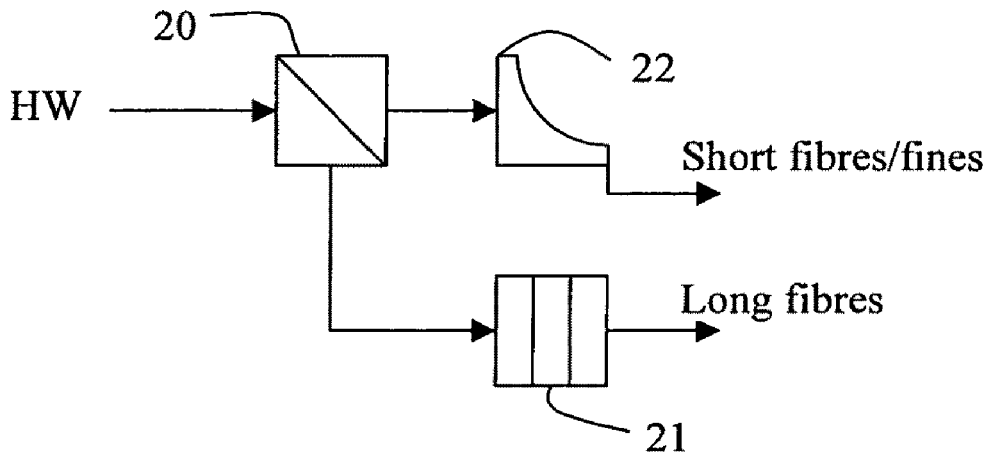
Figure 1C:
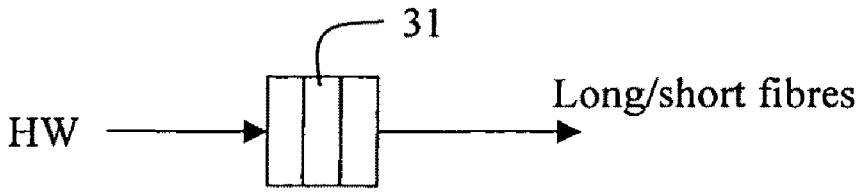

If the fractionation is carried out for instance by using a centrifugal cleaning technique (FIG. 1*b*), the fractionation 20 generates a fines suspension having a consistency of less than 0.1 weight-%, in which case it must be dewatered 22 for instance mechanically or by vaporization, before this fraction can be mixed with the other pulp components of the middle layer. It is possible to refine 21 the long stock fraction in a traditional way but if the share of the fines to be removed is not large enough, the refining must be limited in order to avoid loss of porosity. FIG. 1*c* shows a conventional treatment in which a fraction is refined 31 in a way which is known per se.

According to the present invention, during the screening stage also a fraction, the fines percentage of which has been significantly reduced ("long stock fraction" or the reject of the screening), is recovered. The fraction comprising fewer fines is brought to the refining stage 11, where it is refined to a predefined drainability. Optionally, the fraction comprising fewer fines is used for preparing such a fibre layer that requires good tensile strength properties. Consequently, it is possible to utilize both the fractions comprising fewer fines and the fractions comprising more fines.

The fines fraction is used essentially unrefined or slightly refined in the preparation of the fibre layer, as shown in FIG. 1*a*. Typically, energy used for refining is approximately 0-30 kWh/tonne. Preferably, the fines fraction is mixed with mechanical pulp, most suitably groundwood pulp, refiner mechanical pulp or chemi-thermomechanical pulp, process broke or a combination of these, after which the mixture generated is used to prepare at least one fibre layer of the multilayer product. The share of the fines fraction of the mixture is approximately 5-50 weight-%, preferably approximately 10-30 weight-% of the total weight of the mixture.

Modern paper and cardboard machines generate only small quantities of broke. In situations where relatively little broke is generated, primary pulp must be used instead to glue together the bulky layers, which is expensive. The present invention avoids these problems by using the fines fraction either instead of the broke or in conjunction with it. The resulting product is so strong that the cardboard is able to withstand the mechanical strains of both its production and its use.

By using different fractions, a fibrous product, preferably cardboard, most suitably folding boxboard, is prepared, one having at least two overlapping fibre layers.

According to a preferred embodiment, a three-layer product is prepared, in which the fines are included in the middle layer of the product. The middle layer makes up 30-75 weight-% of the entire amount of fibre of the cardboard product. The product can be symmetrical, in which case the surface and the backing layers are equally thick, or the surface layer can be, for instance, approximately 1.1-3.0 times thicker than the backing layer.

An example of such a multilayer cardboard is a product which comprises, as a combination

- an initial fibre layer, with an outer surface and an inner surface,
- a second fibre layer, which is arranged at a distance from the first layer and which has an outer and an inner surface, in which case the inner surface of the second fibre layer is arranged on the inner side of the first fibre layer, and
- a third fibre layer, which is fitted between the first and the second fibre layer, which multilayer cardboard can be coated, uncoated or coated only on one outer surface.

The sublayers of the multilayer product are attached to each other primarily by hydrogen bonds. If necessary, it is possible to improve the bonding by using adhesives which are generally known.

The typical grammages of three-layer products are of magnitude 50-500 g/m$^2$, of which the grammages of the surface and backing layers are approximately 20-200 g/m$^2$ and of the middle layer 10-450 g/m$^2$.

In tissue applications, it is possible to prepare a product which comprises a middle layer which has a good tensile strength, and which comprises a long stock fraction, and surface layers which comprise fines, and which offer a soft and absorbent surface.

According to another preferred embodiment, a two-layer product is prepared, in which the fines fraction is included in the surface or backing layer of the product. The layer comprising the fines fraction is preferably approximately 50-80 weight-% of all the fibres of the cardboard. Typical grammages of these products are of magnitude 50-400 g/m$^2$, in which case the grammages of the surface and backing layers are approximately 25-200 g/m$^2$ each.

It is obvious that it is possible to mix other pulp in both the fine fibre fraction and the reject from the screening, i.e. the long stock fraction, in order to increase the quantity of the fraction and to modify its properties. However, the quantity of fine fibre fraction generated in the screening from the layer comprising fines fraction of the product forms preferably at least 50% of the dry matter weight of the fibre quantity, preferably at least 75% and preferably 80-100%. Correspondingly, the long stock fraction from the screening forms the main part or even 80-100% of the layer which comprises long stock fraction (of the dry weight of this fibre material). Thus, with this preferable solution it is possible to obtain a product which is generated from one initial material by screening, and which has significantly better properties than a corresponding product, the initial material pulp of which has only been refined.

The purpose of the following example is to describe the present invention but not to restrict it.

EXAMPLE 1

KSK Birch (a commercial birch pulp product obtained from Oy Metsä-Botnia Ab, Kaskinen Mills) was fractionated with a ϕ 0.8 mm hole screen.

| Fractionation: | |
|---|---|
| Screen: | RADISCREEN 1000D ® |
| Aperture size: | Ø 0.8 mm |
| Long stock share (Rm): | 85% |
| Feeding consistency: | 3.1% |

-continued

| Fractionation: | |
|---|---|
| Long stock fraction consistency: | 4.6% |
| Short stock fraction consistency: | 1.1% |
| Temperature: | 20° C. |

The "long stock fraction" was refined using a disc refiner at four different levels of specific energy consumption (43, 56, 68 and 87 kWh/tonne). The samples were analysed and the sheets tested.

The fractionation and the refining are shown in FIG. 1*a* and the reference refining of the unfractionated pulp is shown in FIG. 1*c*.

Figure 2:
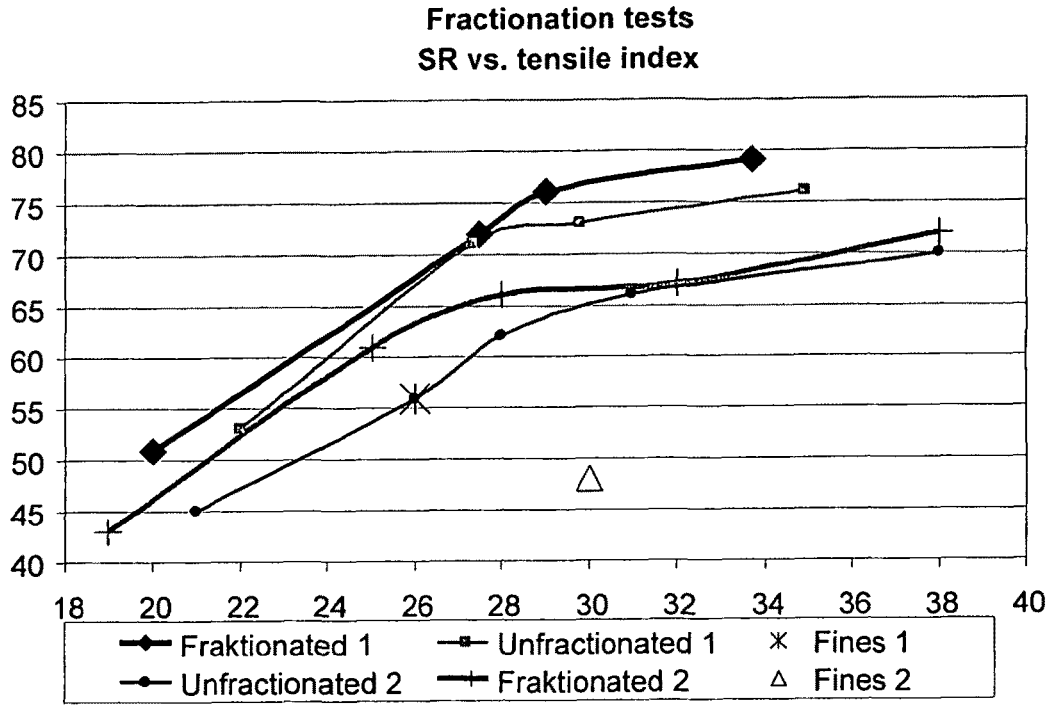
FIG. 2 is a graph of the tensile index as a function of the SR number.

Among other things, the SR number (21->19, fines 30) of the unrefined pulp changed significantly in the fractionation, which shows that the fibre distribution changed significantly. The tensile strength (at constant SR value) of the fractionated long stock fraction was approximately 6% higher than that of the reference pulp (brown against turquoise), FIG. 2 (the tensile index as a function of the SR number).

Figure 3:
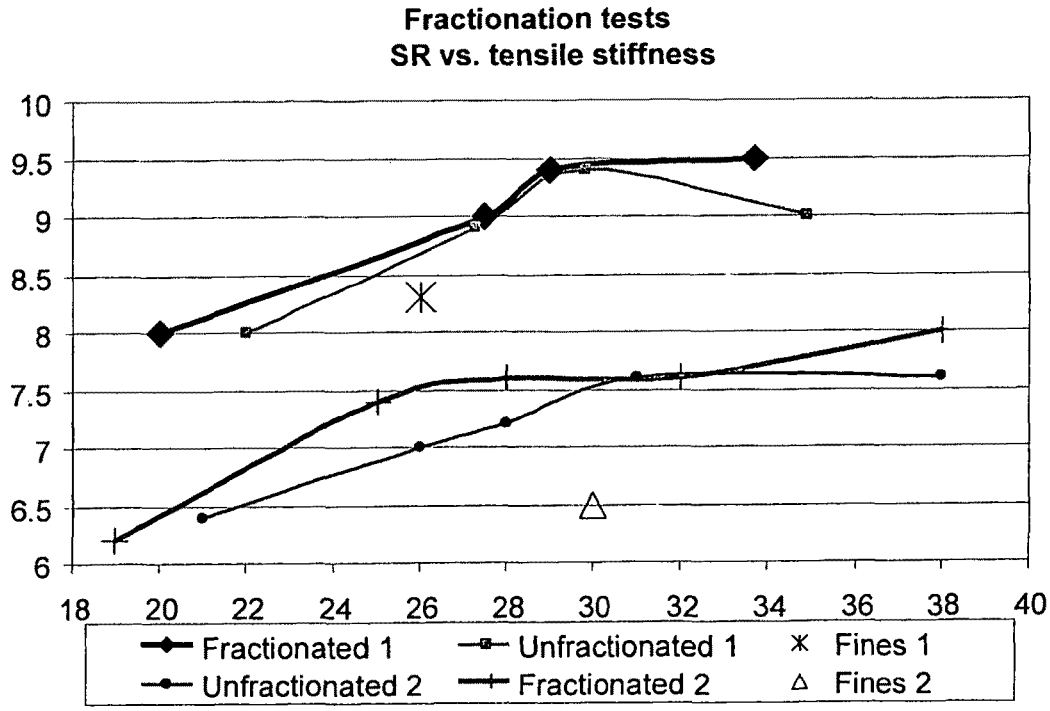
FIG. 3 is a graph of the tensile stiffness as function of the SR number.

Similarly, with the long stock fraction, the tensile stiffness was improved approximately 5% at constant SR value (30) compared with normal unfractionated birch pulp (brown against turquoise) (FIG. 3) (the tensile stiffness as a function of the SR number).

Figure 4:
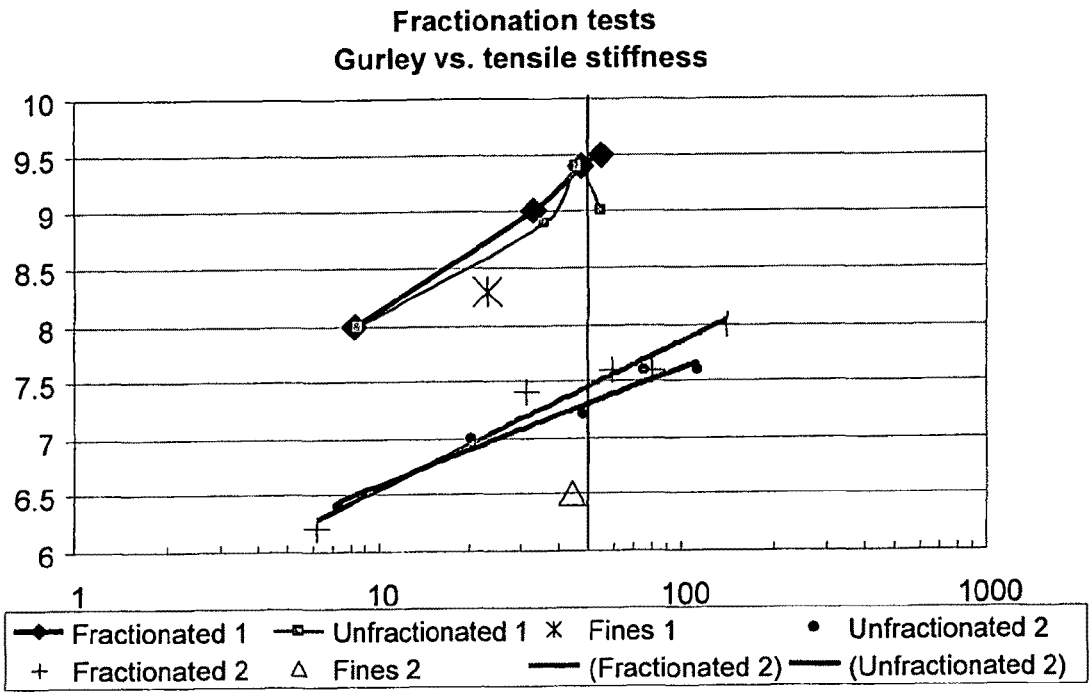
FIG. 4 is a graph of the tensile stiffness as a function of the porosity (Gurley)

With the long stock fraction, the tensile stiffness was improved approximately 4% at a constant Gurley value (50 s) compared with normal unfractionated birch pulp (FIG. 4) (the tensile stiffness as a function of the (Gurley) porosity).

Figure 5:
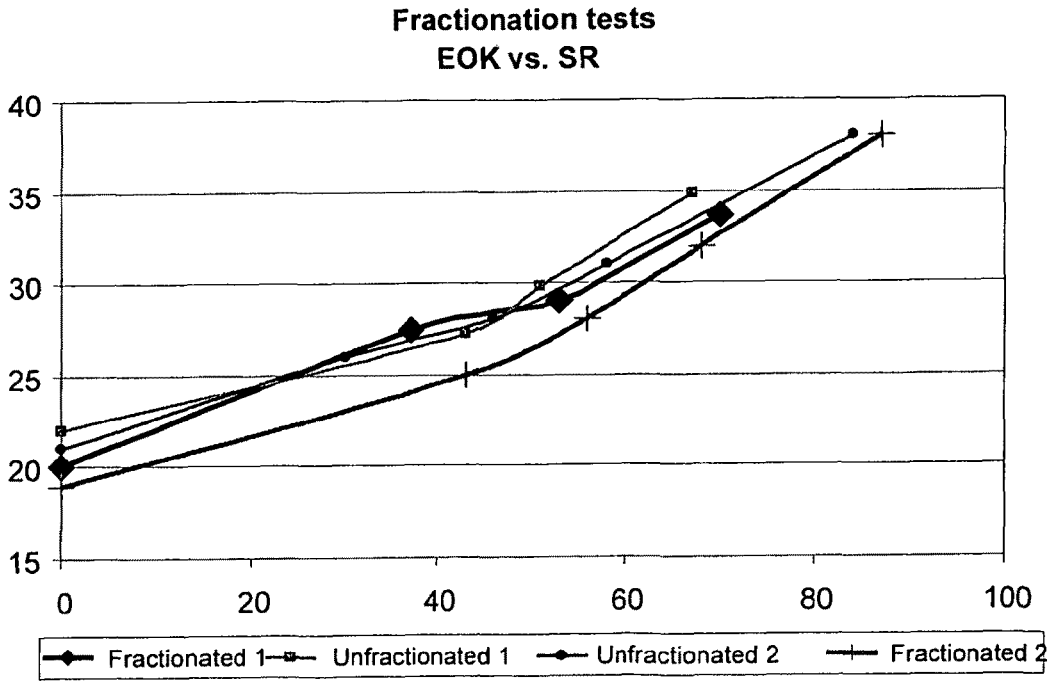
FIG. 5 is a graph of the SR number as a function of the SEC.

The energy used for refining at a constant SR value (30) increased approximately 12% when a fractionated fibre fraction was used (55 kWh/tonne->62 kWh/tonne) (FIG. 5) (the SR number as a function of the SEC).

When employing fractionation, it was possible to reduce slightly the quantity of the fines of the "long stock fraction", compared with normal KSK Birch pulp, but it is possible to decrease the quantity of fines even more by adjusting further the fractionation parameters.

Figure 6:
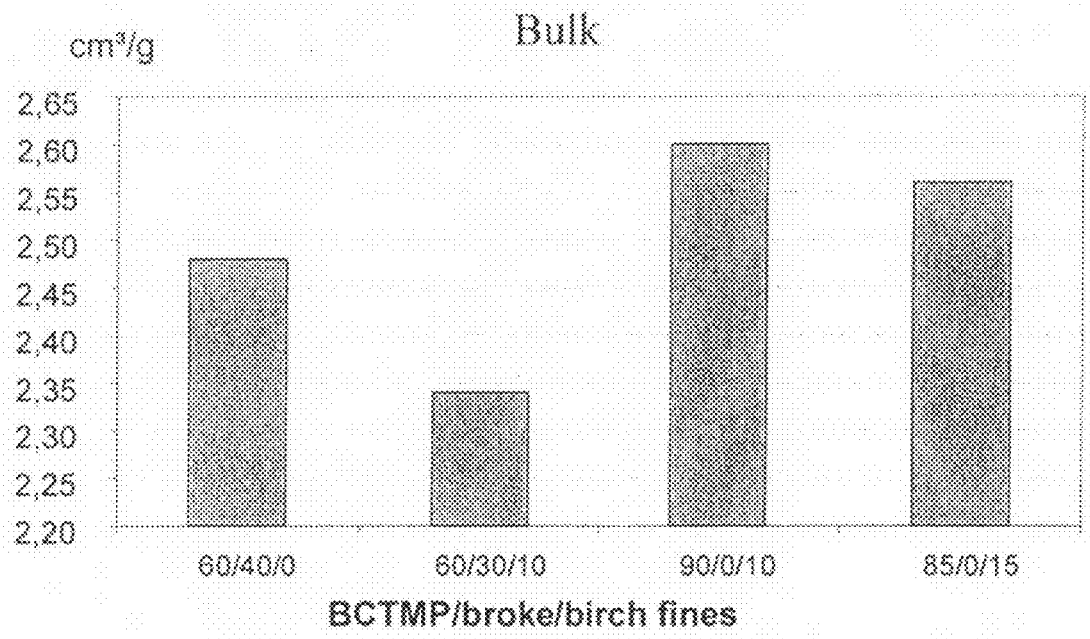
FIG. 6 is a graph of the bulk of the middle layer of compound sheets at different layer compositions.
Figure 7:
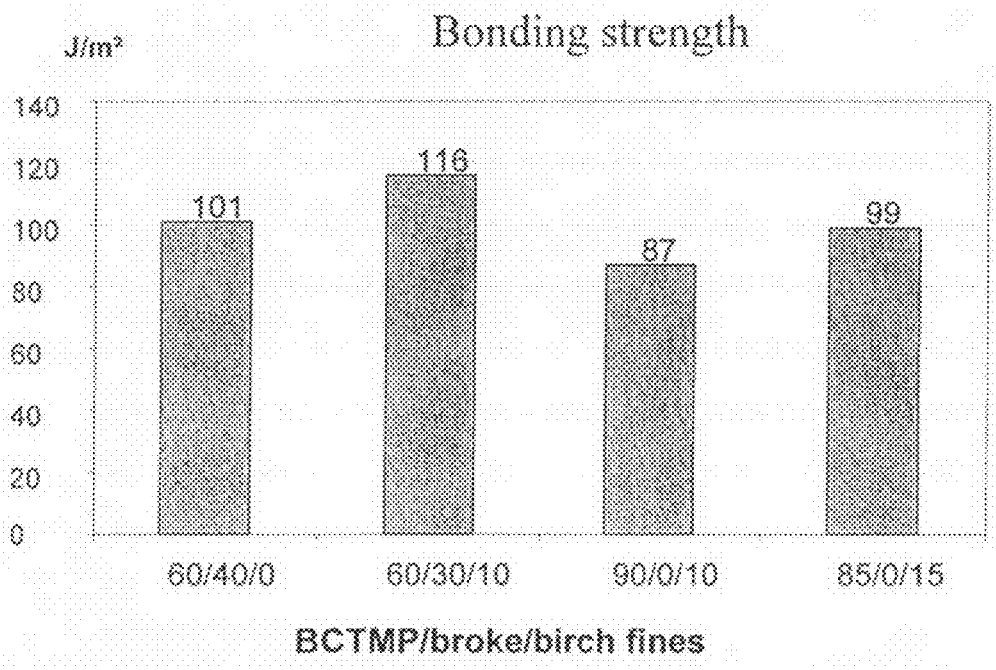
FIG. 7 is a graph of the internal bond strengths of compound sheets at different layer compositions.

By using the compound sheet tests, it is possible to improve the bulk of the middle layer by using fractionated fines (FIG. 6—Compound sheet bulk) instead of using unrefined broke. The internal bond strength was slightly improved when more fines were used as substitutes for the broke generated by the process (FIG. 7—Internal bond strengths of compound sheets). This substitution can be utilized in the refining of the mechanical pulp which is used in the middle layer, by raising its CSF goal, in which case its bulk, too, is improved.

Figure 8:
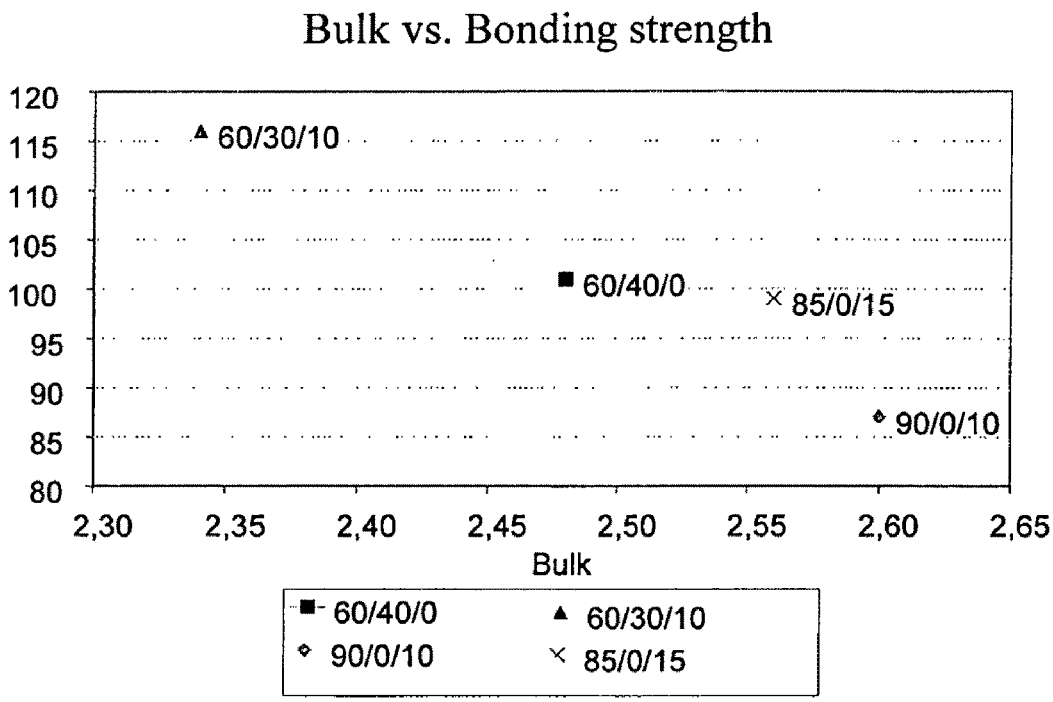
FIG. 8 is a graph of the internal bond strengths of different compound pulps as a function of the bulk.

When the broke pulp is totally substituted by the fines from the fractionation (green x, BCTMP 85/broke 0/fines 15) it is possible to increase the bulk of the mixture while keeping the strength of the internal bond at the same level (FIG. 8—Internal bond strengths of different compound pulps as a function of the bulk).

The invention claimed is:

1. A method of manufacturing a multilayer fibrous product, which product comprises at least two overlapping layers which have different fibre compositions, and which product is manufactured by using at least partially chemical short stock, characterized in that the short stock is subjected to screening, with a screen having an average aperture size of 0.2-1.5 mm, in order to form a fines fraction, the fines being of a size which passes the screen, and a fraction which is retained on the screen, and the obtained fractions are recovered and incorporated into different layers of the same fibrous product, the fines fraction being mixed with mechanical pulp, with broke from the process or with a combination of mechanical pulp and broke to generate a mixture, and then the generated mixture is used to prepare at least one fibre layer of the multilayer product.

2. The method according to claim 1, characterized in that a share of fibre material of approximately 5-30 weight-% is separated from the short stock, which share comprises fines which pass the 0.2-1.5 mm screen.

3. The method according to claim 1, characterized in that the screen has an average hole size of approximately 1.0 mm and at least approximately 5 weight-% of the fibre material of the short stock, is separated from the pulp in the fines fraction.

4. A method according to claim 1, characterized in that the fines fraction is recovered in the form of an aqueous suspension of fibre material.

5. The method according to claim 4, characterized in that the aqueous suspension is used as such, without separate dewatering, in order to prepare a fibrous product.

6. The method according to claim 4, characterized in that the suspension has a consistency of approximately 0.5-2 weight %.

7. The method according to claim 1, characterized in that the share of the fines fraction in the generated mixture is approximately 5-50% of the total weight of the mixture.

8. A method according, to claim 1, characterized in that the fines fraction is used essentially unrefined to prepare the fibre layer.

9. A method according to claim 1, characterized in that in the screening, a fraction having a significantly reduced percentage of fines is recovered.

10. The method according to claim 9, characterized in that the fraction having a significantly reduced percentage of fines is subjected to refining, whereby it is refined to a predefined drainability and porosity.

11. The method according to claim 9, characterized in that the fraction having a significantly reduced percentage of fines is used to prepare a fibre layer which requires good tensile strength properties.

12. A method according to claim 1, characterized in that a three-layer product is prepared, in which case the fines fraction is included in the middle layer of the product.

13. The method according to claim 1, characterized in that a two-layer product is prepared, in which case the fines fraction is included in the surface layer or backing layer of the product.

14. A method according to claim 1, characterized in that the short stock is a chemical pulp which is prepared from hardwood by using an alkaline cooking method.

15. A method according to claim 1, characterized in that the short stock is prepared by using as raw material wood of the *Betula* genera, *Populus* genera, *Eucalyptus* genera or the *Akasia* genera, or a mixture of these.

16. The method according to claim 15, characterized by producing a fibrous product in which 50-100% of the fibres comprise short stock.

17. The method according to claim 16, characterized by producing a fibrous product in which 100% of the fresh feed fibres comprise short stock.

18. The method according to claim 1, characterized by producing a fibrous product in which 1-50% of the fibres comprise softwood fibres.

19. The method according to claim 3, characterized in that 5-30 weight-% of the fibre material of the short stock is separated from the pulp in the fines fraction.

20. The method according to claim 6, characterized in that the suspension has a consistency of 0.8-1.5 weight-%.

21. The method according to claim 7, characterized in that the share of the fines fraction, in the generated mixture is 10-90% of the total weight of the mixture.

22. The method according to claim 18, characterized by producing a fibrous product in which 10-45% of the fibres comprise softwood fibres.

* * * * *